United States Patent [19]

Walter

[11] 4,126,583

[45] Nov. 21, 1978

[54] HIGH TEMPERATURE THERMISTORS (NTC)

[75] Inventor: Ulrich Walter, Munich, Germany

[73] Assignee: Siemens Aktiengesellschaft, Berlin & Munich, Germany

[21] Appl. No.: 822,196

[22] Filed: Aug. 5, 1977

[30] Foreign Application Priority Data

Aug. 18, 1976 [DE] Fed. Rep. of Germany ..... 2637225
Aug. 18, 1976 [DE] Fed. Rep. of Germany ..... 2637227

[51] Int. Cl.[2] ..... H01B 1/08

[52] U.S. Cl. ..... 252/521; 106/73.2; 338/22 R

[58] Field of Search ..... 252/521; 106/73.2; 338/22 R

[56] References Cited

U.S. PATENT DOCUMENTS 4,010,119 3/1977 Walch ..... 252/521
4,010,122 3/1977 Walch ..... 252/521

OTHER PUBLICATIONS

*Advanced Inorganic Chemistry* (3rd Ed.), Cotton, F. Albert and Wilkinson, Geoffrey (1972), p. 1056.

*Primary Examiner*—Benjamin R. Padgett
*Assistant Examiner*—E. Suzanne Parr
*Attorney, Agent, or Firm*—Hill, Gross, Simpson, Van Santen, Steadman, Chiara & Simpson

[57] ABSTRACT

Thermistors (NTC) containing a mixture of terbium oxide and a material selected from the group consisting of samarium and ytterbium oxide are useful in high temperature environments.

8 Claims, 2 Drawing Figures

$R_{spez}/\Omega \cdot cm$
$10^6$
$10^5$
$10^4$
$10^3$
$10^2$
200
300
400
500
600
700
800
900
1100
t/°C
1
2
3
10at.% Tb 90at.% Yb
30at.% Tb 70at.% Yb
40at.% Tb 60at.% Yb $R_{spez}/\Omega \cdot cm$
$10^6$
$10^5$
$10^4$
$10^3$
$10^2$
200
300
400
500
600
700
800
900
1100
t/°C
5
4
40 at % Tb 60 at. % Sm
60 at. % Tb 40 at. % Sm

HIGH TEMPERATURE THERMISTORS (NTC)

BACKGROUND OF THE INVENTION

1. Field of the Invention

The invention relates to thermistors and somewhat more particularly to thermistors composed of a sintered oxide mixture containing rare earth metals.

2. Prior Art

Resistor elements which possess a negative temperature coefficient of resistance are generally referred to as thermistors or NTC-resistors. Generally, such thermistors are composed of sintered oxides of manganese, iron, cobalt, nickel, copper, zinc and mixtures thereof.

Thermistors composed of such metal oxides and mixtures thereof are typically not suited for high temperature applications because these metal oxides and mixtures thereof decompose at temperatures above about 600° C. Further, since irreversible changes may occur within thermistors of this type even at lower temperatures, the prior art has generally limited their usage to maximum temperatures in the range of about 300° to 350° C.

Measurement and/or control of temperatures in the range of about 600° to 1100° C. was heretofore effected by utilizing either pyrometers, metal resistors or thermocouple elements. However, pyrometers are characteristically relatively inaccurate for temperature measurement so that it is virtually impossible to use pyrometers for accurate temperature control. Metal resistors have a low temperature coefficient of resistance so that amplifiers are typically required whenever metal resistors are utilized for temperature control. Finally, thermocouple elements suitable for high temperature environments can only be produced from relatively high-costing platinum metals.

The prior art is aware that thermistors usable at higher or high temperatures may be produced from a mixture of a rare earth metal oxide and zirconium oxide. For example, British patent specification No. 874,882 suggests a thermistors comprised of a mixture of yttrium and zirconium oxide while German Offenlegungsschrift No. 2,333,189 suggests a thermistors composed of a mixture of praseodymium and zirconium oxide. However, thermistors composed of such materials exhibit a varistor effect, i.e., the resistance values of such thermistors is dependent not only upon the temperature but also on the applied voltage.

"Zeitschrift fur Electrochemie" (Journal for Electro-Chemistry) 1959, pages 269–274, suggests that the conductivity of rare earths increases with rising temperatures, however, no suggestions are made for incorporating rate earths or mixtures thereof in thermistors.

Further, U.S. Pat. No. 4,010,119 suggests a thermistor comprised of a mixture of neodymium oxide and samarium oxide while U.S. Pat. No. 4,010,122 suggests a thermistor composed of a mixture of terbium oxide and erbium oxide. However, thermistors composed of such materials exhibit a relatively high specific resistance and thus cannot be utilized at relatively low temperatures or over an extended operating temperature range.

Thus, previously known thermistors useful in high temperature environments are either too highly ohmic, have too low of temperature coefficients of the resistance value, exhibit varistor effects and polarization phenomena or have too narrow of an operative temperature range.

SUMMARY OF THE INVENTION

The invention provides thermistors composed of a sintered oxide material containing a mixture of terbium oxide and a material selected from the group consisting of samarium oxide and ytterbium oxide and which are useful in high temperature environments to measure and/or regulation temperatures. The thermistors of the invention exhibit a high temperature coefficient of the resistance value with a relatively low specific resistance and exhibit no varistor effects or polarization phenomena.

Preferred embodiments of thermistors produced in accordance with the principles of the invention contain about 10 to 90 atom % of terbium.

DESCRIPTION OF THE PREFERRED EMBODIMENTS

The invention provides a thermistor useful in high temperature environments for measuring and controlling a temperature over a relatively wide operating range. The thermistors of the invention exhibit a high temperature coefficient of their resistance value with a relatively low specific resistance and do not exhibit varistor effects or polarization phenomena.

In accordance with the principles of the invention, a thermistor is formed so as to contain a mixture of terbium oxide and a material selected from the group consisting of samarium oxide and ytterbium oxide.

In a preferred embodiment of the invention, the thermistors contain about 10 to 90 atom % of terbium.

Thermistors produced in accordance with the principles of the invention exhibit a relatively high temperature coefficient of the resistance value thereof while possessing a low specific resistance. Thermistors of the invention exhibit no varistor effect and even when a measuring voltage is connected thereto, no polarization phenomena is displayed. Since rare earths possess a very high formation enthalpy, they do not decompose until temperatures above at least 1750° C. are encountered so that thermistors formed in accordance with the principles of the invention can be used for measuring and regulating relatively very high temperatures.

Thermistors produced in accordance with the principles of the invention may, if desired, contain up to 2 weight % of calcium oxide therein as a mineralizing or calcination agent, without any substantial change in their electrical values and/or properties.

With the foregoing general discussion in mind, there is now presented a detailed example which will illustrate to those skilled in the art the manner in which the invention is carried out. However, these examples are not to be construed as limiting the scope of the invention in any way.

EXAMPLE I

A starting mixture of terbium oxide (purity of 99.9%) and ytterbium oxide (purity of 99.9%) was prepared so that the mixture contained about 10 atom % of terbium. This mixture was dissolved in hydrochloric acid and the rare earths were then conventionally coprecipitated as oxalates. The precipitated oxalates were filtered off, calcinated at a temperature of about 900° C. and then finally ground to produce substantially uniform size oxide particles. For the production of a thermistor, the calcinated and ground oxide mixture was provided with a suitable bonding agent and formed into a bead between two parallelly clamped wires composed of platinum or a platinum alloy. This structure was then subjected to a preliminary drying and the thermistor bead was then sintered at temperatures in the range of about 1550° to 1700° C. in a suitable furnace containing an oxidizing atmosphere.

Figure 1:
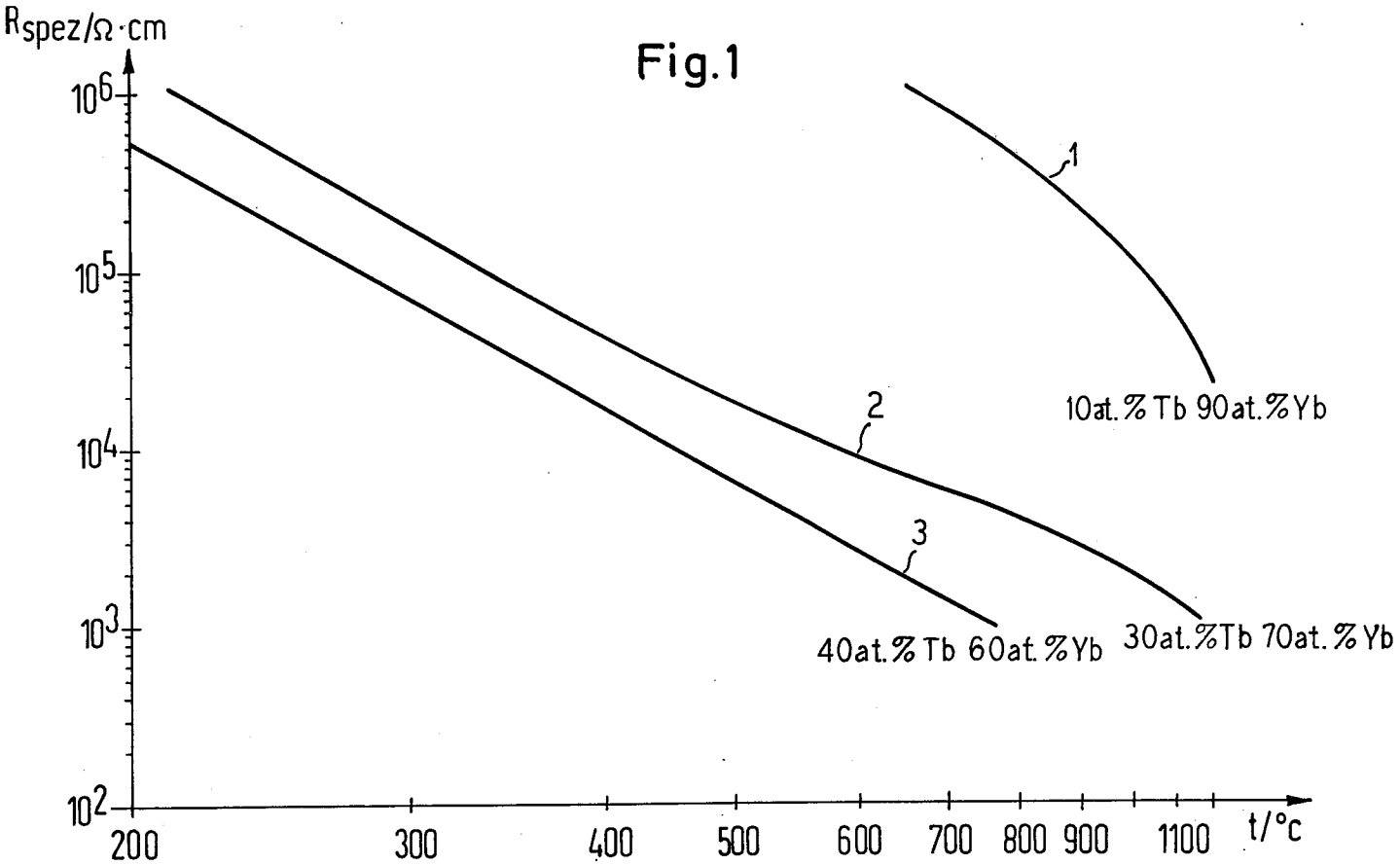
FIG. 1 is a graphical illustration of the specific resistance, $R_{spez/\Omega.\ cm}$ of one embodiment of thermistors produced in accordance with the principles of the invention as it relates to a temperature, t, over the range of about 200° to 1100° C.

The resultant thermistor was subjected to a high temperature environment and the specific resistance thereof measured. The average results are graphically illustrated at curve 1 in FIG. 1.

In accordance with a desired utility, the sintered bead may be provided with a glass coating or positioned within a suitable housing composed of glass, quartz crystal, aluminum oxide, etc. Generally, when thermistors of the invention are to be utilized in a reactive environment, it is preferable to provide a protective coating or housing about the thermistor.

EXAMPLE II

A thermistor was produced essentially as explained in connection with Example I, except that the starting mixture contained about 30 atom % of terbium. The resultant thermistor was subjected to a high temperature environment and specific resistance thereof measured. The average results are graphically illustrated on curve 2 of FIG. 1.

EXAMPLE III

Another group of thermistors was produced essentially in the manner described in Example I, except that the starting mixture contained about 40 atom % of terbium. The resultant thermistors were subjected to a high temperature environment and the specific resistance thereof measured. The average results are graphically illustrated on curve 3 of FIG. 1.

EXAMPLE IV

Figure 2:
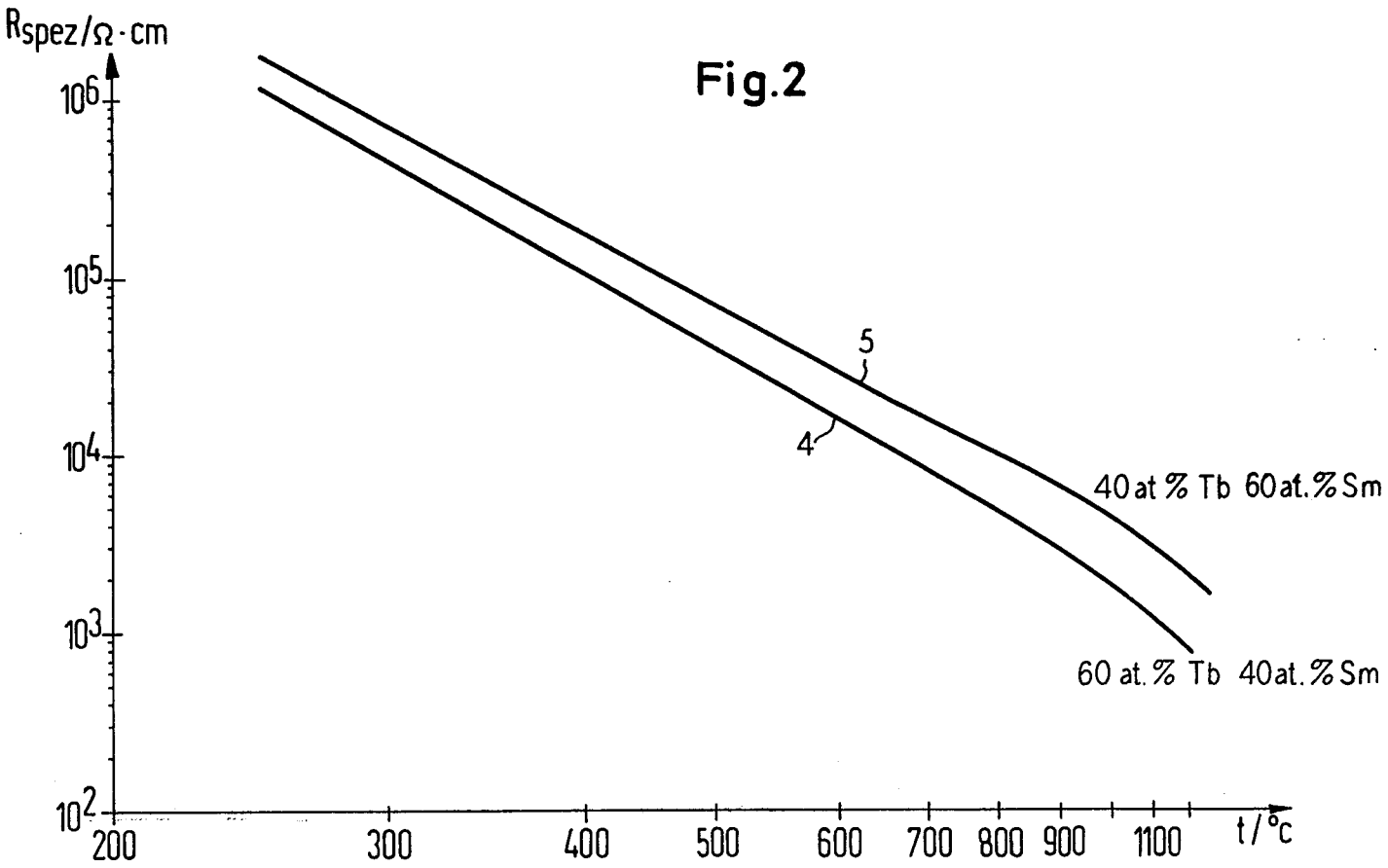
FIG. 2 is a somewhat similar graphical illustration of the specific resistance of another embodiment of thermistors produced in accordance with the principles of the invention as it relates to the indicated temperature range.

Another group of thermistors was produced essentially in the manner as described in Example I, except that the starting mixture contained about 60 atom % terbium and 40 atom % samarium (purity of 99.9%). The resultant thermistors were subjected to a high temperature environment and the specific resistance thereof measured. The average results are graphically illustrated on curve 4 at FIG. 2.

EXAMPLE V

Another group of thermistors was produced essentially in the same manner as described in Example I, except that the starting mixture contained about 40 atom % terbium and 60 atom % samarium. The resultant thermistors were subjected to a high temperature environment and the specific resistance thereof measured. The average results are graphically illustrated on curve 5 in FIG. 2.

As can be seen from the illustrated curves, the resistance values of thermistors used in accordance with the principles of the invention change constantly or relatively constantly within the entire operative temperature range.

Thermistors produced in accordance with the principles of the invention are suitable for temperature measurement and/or regulation above about 200° C.

Thermistors produced in accordance with the principles of the invention are useful in monitoring motor vehicle exhaust gases, smelt furnaces in the glass industry, ovens in the metallurgical and chemical industry, as well as in domestic household equipment.

The thermistors produced in accordance with the principles of the invention may be formed not only in the bead form described in the Examples, but also in any desired form, such as in the form of discs, rods or tubes.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

I claim as my invention:

1. A thermistor for use in high temperature environments comprised of a sintered oxide material containing a rare earth metal mixture therein, said rare earth metal mixture consisting essentially of a mixture of terbium oxide and a material selected from the group consisting of samarium oxide and ytterbium oxide, said thermistor having an operating temperature extending from about 200° C. to 1100° C.

2. A thermistor as defined in claim 1 wherein said rare earth mixture consists essentially of about 10 to 90 atom % of terbium.

3. A thermistor as defined in claim 1 wherein said sintered oxide material contains up to about 2 weight % calcium oxide.

4. A thermistor as defined in claim 1 wherein said rare earth mixture consists of about 10 atom % of terbium and about 90 atom % of ytterbium.

5. A thermistor as defined in claim 1 wherein said rare earth mixture consists of about 30 atom % of terbium and about 70 atom % of ytterbium.

6. A thermistor as defined in claim 1 wherein said rare earth mixture consists of about 40 atom % of terbium and about 60 atom % of ytterbium.

7. A thermistor as defined in claim 1 wherein said rare earth mixture consists of about 40 atom % of terbium and about 60 atom % of samarium.

8. A thermistor as defined in claim 1 wherein said rare earth mixture consists of about 60 atom % of terbium and about 40 atom % of samarium.

* * * * *